US005137502A

United States Patent [19]

Anastasi

[11] Patent Number: 5,137,502

[45] Date of Patent: Aug. 11, 1992

[54] WEIGHT FOR PHYSICAL FITNESS HAVING AN INTEGRALLY MADE HANDLE

[76] Inventor: Christopher Anastasi, 26433 Portola, Misson Viejo, Calif. 92692

[21] Appl. No.: 642,808

[22] Filed: Jan. 18, 1991

[51] Int. Cl.[5] ..... A63B 21/072

[52] U.S. Cl. ..... 482/106; 482/108; 482/105; 482/93

[58] Field of Search ..... 272/117, 119, 122, 123, 272/143, 67, 68; 2/160, 161 A

[56] References Cited

U.S. PATENT DOCUMENTS

| | | | |
|---|---|---|---|
| D, 274,283 | 6/1984 | Wright | 272/122 |
| 1,047,212 | 12/1912 | Hamilton | 272/119 |
| 3,572,702 | 3/1971 | Dorn | 272/123 |
| 3,771,785 | 11/1973 | Speyer | 272/123 |
| 3,796,431 | 3/1974 | Sinyard | 272/122 |
| 4,079,932 | 3/1978 | Schuertz | 272/122 |
| 4,373,717 | 2/1983 | Lambert, Jr. | 272/67 |

*Primary Examiner*—Richard J. Apley
*Assistant Examiner*—Lynne A. Reichard
*Attorney, Agent, or Firm*—Price, Gess & Ubell

[57] ABSTRACT

A disc-shaped weight includes a circular opening in the center and a pair of diametrically opposed, elongated oval openings disposed parallel to one another and equidistant from the circular opening. The oval openings are positioned in the disc-shaped weight so that the fingers and thumb of a human hand may be disposed through the openings for sufficient gripping of the weight. The distance between the outer periphery of the elongated side of either opening, proximal to the outer periphery of the disc member, is dimensioned so that the fingers of a human hand can be disposed through the desired opening and the thumb can be wrapped around the outer periphery of the weight, for sufficient gripping of the weight. The periphery of the elongated oval openings and outer periphery of the weight is rounded to aid in gripping of the weight.

11 Claims, 1 Drawing Sheet

WEIGHT FOR PHYSICAL FITNESS HAVING AN INTEGRALLY MADE HANDLE

BACKGROUND OF THE INVENTION

1. Field of the Invention

The subject invention relates generally to physical fitness equipment and, more particularly, to a weight having openings for gripping the weight.

2. Description of Related Art

Weights that are used with dumbbells and barbells are difficult to grasp and use as an independent exercise implement. Conventional weights used with dumbbells and barbells are usually disc-shaped and have an opening in the center for mounting the weight onto a dumbbell or barbell. The weights increase in diameter and width as the size of weight increases. Weights are typically in pound increments of 2-½, 5, 10, 25, 35, and 45 pounds.

Weights are difficult to hold because they do not give way to pressure applied when grasping them. Thus, weights tend to slip out of the user's hand when mounting them onto the barbell or dumbbell or when trying to use the weight alone as an exercise implement. Thus, the use of an independent weight as an exercise implement can be dangerous when the weight slips out of one's hand, and may cause harm to the user or persons or property nearby.

SUMMARY OF THE INVENTION

It is therefore an object of the present invention to provide an improved weight used for physical fitness;

It is another object of the invention to provide a weight that may be securely held by a single human hand;

It is a further object of the invention to provide a weight that has an integrally-formed gripping means; and It is yet another object of the invention to provide a weight that can be mounted on a barbell or dumbbell and held by a single human hand.

These and other objects and advantages of the present invention are achieved by providing a weight having a gripping means for holding the weight. The weight may be disc-shaped and include a circular opening in the center for mounting the weight onto a barbell or dumbbell.

In a preferred embodiment, the gripping means includes a pair of diametrically opposed, elongated openings disposed parallel to one another and equidistant from the circular opening. The oval openings are positioned in the disc member so that the fingers and thumb of a human hand can be disposed through the openings for sufficient gripping of the weight.

The distance between the outer periphery of the elongated side of either oval opening adjacent to the outer periphery of the disc-shaped weight is dimensioned so that the fingers of the human hand can be disposed through the oval opening and the thumb can be wrapped around the outer periphery of the weight. The periphery of the elongated oval openings and outer periphery of the weight are rounded to aid in gripping of the weight.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DESCRIPTION OF THE PREFERRED EMBODIMENTS

The following description is provided to enable any person skilled in the art to make and use the invention and sets forth the best modes contemplated by the invention of carrying out his invention. Various modifications, however, will remain readily apparent to those skilled in these arts, since the generic principles of the present invention have been defined herein.

Figure 1:
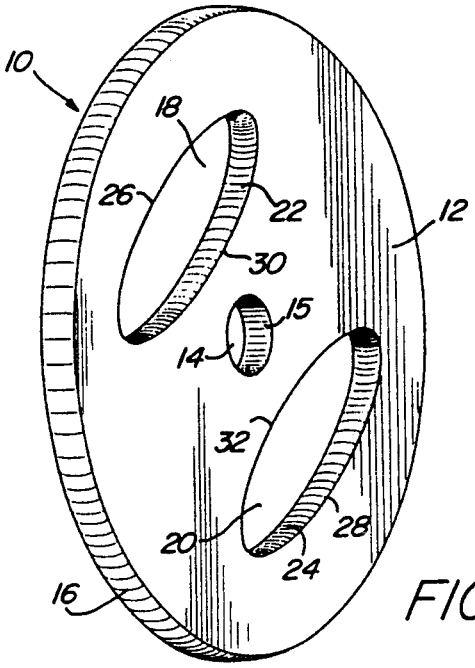
FIG. 1 is a perspective view of a preferred embodiment of the present invention.

FIG. 1 shows a weights 10 constructed according to the preferred embodiment of the present invention. The weight 10 includes a disc member 12 having a circular opening 14 disposed in the center and a rounded outer periphery 16.

Disposed on either side of the circular opening 14 are a pair of diametrically opposed, elongated oval openings 18, 20. The oval openings 18, 20 are disposed parallel to one another and equidistant from the circular opening 14. The oval openings 18, 20 are positioned in the disc member 12 so that the fingers and thumb of a human hand (not shown) can be disposed through the openings 18, 20 for sufficient gripping of the weight 10.

The distance between an outer elongated side 26, 28 of either oval opening 18, 20 is dimensioned so that the fingers of the human hand can be disposed through the desired oval opening 18, 20 and the thumb can be wrapped around the outer periphery 16 of the disc member 12 for sufficient gripping of the weight 10. The periphery 22, 24 of the oval openings 18, 20 is rounded to aid in gripping the weight 10. The weight 10, when designed to weigh approximately five pounds, may have a diameter of 8 inches and a width of ½ inch.

The circular opening 14 may be different diameters to accommodate different barbells and dumbbells. In the preferred embodiment, the diameter of the circular opening 14 is approximately 1-¼ inches.

Inner sides 30, 32 of the oval openings 18, 20 may be disposed ¾ inch from the circular opening's 14 outer periphery 15. The outer sides 26, 28 of the respective oval openings 18, 20 are 1-½ inches from the disc member's 12 outer periphery 16.

The oval openings 18, 20 shown are 4 inches in length and have a maximum width of 1-½ inches. The oval opening's 18, 20 inner periphery 22, 24 is rounded to aid in gripping the weight 10.

The weight 10 may comprise a suitable metal, such as iron. The weight 10 may be covered with a plastic coating (not shown) for comfort when gripping the weight 10. The weight 10 may also comprise a rigid plastic shell filled with sand.

Figure 2:
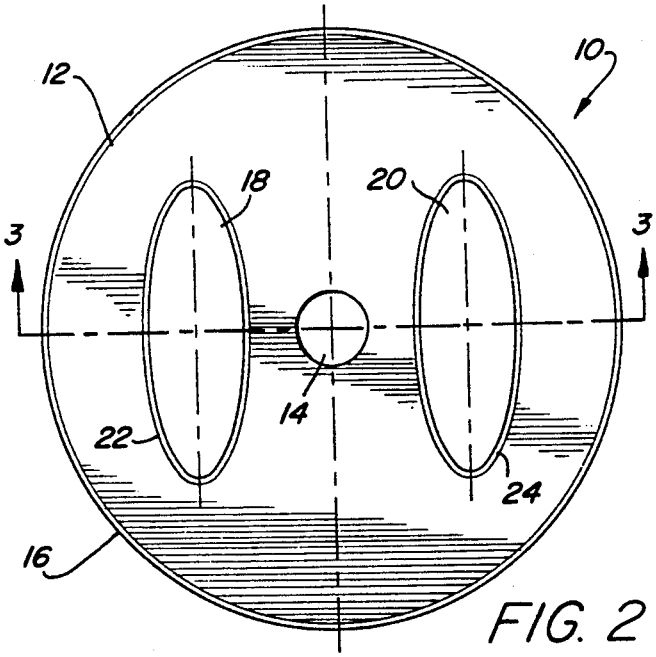
FIG. 2 is a plan view of the preferred embodiment.

FIG. 2 shows a plan view of the invented weight 10. Both elongated oval openings 18, 20 have their centers aligned with the center of the circular opening 14. The oval openings 18, 20 are disposed parallel to one another in the disc member 12 and equidistant to the circular opening 14.

Figure 3:
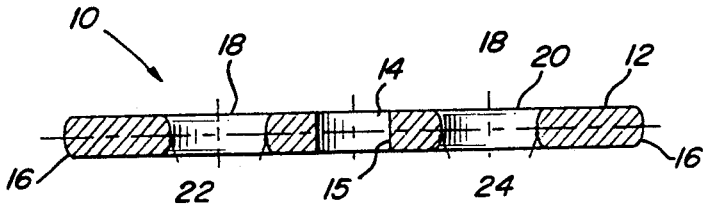
FIG. 3 is a cross-sectional view of the preferred embodiment of the present invention.

FIG. 3 shows a cross-sectional view of the invented weight 10 taken along the lines A—A of FIG. 2. The circular opening 14 has its inner periphery 15 perpendicular to the disc member 12 to aid in coupling the weight 10 to a barbell or dumbbell. The disc member's 12 outer periphery 16 is rounded, as is the inner periphery 22, 24 of both oval openings 18, 20. The rounded periphery 16, 22, 24 of the disc member 12 and both oval openings 18, 20 enhances grasping of the weight 10.

When using the weight 10, the fingers of the human hand may be placed through either elongated oval opening 18, 20, and the thumb of the hand may be placed through the remaining oval opening 18, 20 to grip the weight 10. By holding the weight 10 in this fashion, exercises such as those usually performed with dumbbells may be performed.

The invented weight 10 may also be held by placing the fingers of the hand through the desired oval opening 18, 20 and wrapping the thumb around the outer periphery 16 of the disc member 12 to grip the weight 10. Exercises using the weight independently of any other apparatus may also be performed by holding the weight in this fashion.

The oval openings 18, 20 also enhance the ease with which the weight 10 may be placed onto a desired barbell or dumbbell. The fingers of one hand may be placed through the desired opening 18, 20, and the thumb is then wrapped around the disc member's 12 adjacent outer periphery 16, and the fingers of the remaining hand may be placed through the remaining opening 18, 20, and the thumb wrapped around the adjacent outer periphery 16 of the disc member 12 to securely grip the weight 10 with both hands. The weight may then be lifted and placed onto a desired barbell or dumbbell by disposing the barbell or dumbbell through the circular opening 14.

The preferred embodiment of the present invention provides a disc-shaped weight having a gripping means for holding the weight. The gripping means of the invented weight enhance the weight's use as an independent exercise implement and as an effective way to hold the weight to prevent it from slipping from one's hand.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. An improved weight used for physical fitness comprising:

an integrally formed disc member having a circular opening in the center thereof and having a pair of generally diametrically opposed elongated openings parallel to one another and equidistant from said circular opening, centers of said elongated openings being located at least midway out from the center of the disc member to an outer periphery of the disc member.

2. The weight of claim 1 wherein the entire periphery of said elongated openings and the outer periphery of said disc member is rounded.

3. The weight of claim 2 wherein the circular openings said disc member is sized to accommodate a barbell.

4. The weight of claim 3 wherein said disc member comprises iron.

5. The weight of claim 4 wherein said disc member has a plastic coating thereon.

6. The weight of claim 4 wherein said disc member has chrome plating thereon.

7. The weight of claim 3 wherein said disc member comprises a rigid plastic shell filled with sand.

8. An improved weight for physical fitness having an integrally made gripping means comprising:

a disc member comprising iron, having a circular opening in the center thereof, and having the outer periphery thereof rounded; and a pair of diametrically opposed, elongated openings disposed parallel to one another and equidistant from said circular opening in said disc member, the center of said elongated openings in substantial alignment with the center of said circular opening, centers of said elongated openings being located at least midway out from the center of the disc member to the outer periphery of the disc member, the periphery of said elongated openings being rounded.

9. The weight of claim 8 wherein the circular opening in said disc member is sized to accommodate a barbell.

10. The improved weight of claim 8, wherein centers of said elongated openings are located equidistant between the center of the disc member and the outer periphery of the disc member.

11. An improved weight for physical fitness, comprising:

an integrally-formed disc member having a circular opening in the center thereof and having a pair of generally diametrically opposed elongated openings parallel to one another and equidistant from said circular opening, wherein centers of said elongated openings are located equidistant between the center of the disc member and an outer periphery of the disc member.

* * * * *